US006248164B1

(12) United States Patent
Håkansson

(10) Patent No.: US 6,248,164 B1
(45) Date of Patent: Jun. 19, 2001

(54) SIZE COMPOSITION, METHOD FOR ITS PREPARATION, AND USE THEREOF

(75) Inventor: Philip Håkansson, Sölvesborg (SE)

(73) Assignee: Stora Kopparbergs Bergslags Aktiebolag (publ), Falun (SE)

( * ) Notice: Subject to any disclaimer, the term of this patent is extended or adjusted under 35 U.S.C. 154(b) by 0 days.

(21) Appl. No.: 09/155,483

(22) PCT Filed: Mar. 20, 1997

(86) PCT No.: PCT/SE97/00467

§ 371 Date: Sep. 29, 1998

§ 102(e) Date: Sep. 29, 1998

(87) PCT Pub. No.: WO97/37079

PCT Pub. Date: Oct. 9, 1997

(30) Foreign Application Priority Data

Mar. 29, 1996 (SE) ..... 9601225

(51) Int. Cl.[7] ..... D21H 17/17; D21H 17/15

(52) U.S. Cl. ..... 106/287.2; 106/209.1; 162/158

(58) Field of Search ..... 106/209.1, 287.2; 162/158

(56) References Cited

U.S. PATENT DOCUMENTS

| | | | | |
|---|---|---|---|---|
| 4,743,303 | | 5/1988 | Helmer et al. . | |
| 4,859,244 | * | 8/1989 | Floyd | 106/243 |
| 5,407,537 | * | 4/1995 | Maltesta et al. | 162/158 |
| 5,472,485 | * | 12/1995 | Pandian et al. | 106/194 |
| 5,484,509 | * | 1/1996 | Famili et al. | 162/135 |
| 5,759,249 | * | 6/1998 | Wasser | 106/209.1 |
| 5,885,340 | * | 3/1999 | Bailey et al. | 106/209.1 |

FOREIGN PATENT DOCUMENTS

| | | |
|---|---|---|
| 0 693 589 A1 | 1/1996 | (EP) . |
| 96/23105 | 8/1996 | (WO) . |

* cited by examiner

*Primary Examiner*—David Brunsman
(74) *Attorney, Agent, or Firm*—Nixon & Vanderhye

(57) ABSTRACT

A size composition in the form of an aqueous emulsion or dispersion comprises hydrophobic cellulose-reactive particles, which exist as a physical mixture of at least two hydrophobic, cellulose-reactive sizing agents, comprising alkyl keten dimer (AKD) and alkenyl succenic acid anhydride (ASA) as well as starch and/or synthetic polymer.

11 Claims, No Drawings

SIZE COMPOSITION, METHOD FOR ITS PREPARATION, AND USE THEREOF

This application is a 371 of PCT/SE97/00467 filed Mar. 20, 1997.

TECHNICAL FIELD

The invention relates to a new composition which is useful as a so called size composition in connection with manufacturing of paper, board, paper board and similar products. The invention also relates to a method for the preparation of the said composition and to a use thereof, namely in connection with a method for the manufacturing of sized paper, sized board, or sized paper board. Finally, the invention relates to sized paper, sized board, or sized paper board, wherein the paper, board or paper board has been manufactured according to the said method.

More precisely, the invention relates to a composition in the form of an aqueous (water based) emulsion or dispersion comprising at least any hydrophobic, cellulose-reactive sizing agent and at least a natural and/or synthetic polymer.

BACKGROUND OF THE INVENTION

As far as most paper, board and paper board grades are concerned, there is a need to reduce the rate of liquid penetration into the structure of the paper, board, or paper board through the addition of hydrophobic substances during the paper manufacturing process. Copying paper, writing and printing papers, papers for so called inkjet printers, and paper board for packages for juice, milk and other liquids are examples of such paper, board, and paper board grades.

These grades for their proper use need to have some liquid repellent features. Different methods are available or the achievement of that effect. One of them includes the addition of an emulsion for dispersion of a hydrophobic material during the paper manufacturing process.

Aqueous emulsions and dispersions of hydrophobic cellulose-reactive type are previously known per se. These emulsions and dispersions, however, are manufactured of only a single hydrophobic, cellulose-reactive sizing agent.

Many different hydrophobic materials can be used. The so called hydrophobic, cellulose-reactive sizing agents belong to the most efficient ones. It is believed that the hydrophobic effect, when using that type of agent, is achieved through a reaction between the hydrophobic material and the hydroxyl groups of the cellulose.

The hydrophobic, cellulose-reactive materials which are most commonly used in connection with neutral or weakly alkalic conditions during the paper or paper board manufacturing process are alkyl ketene dimer (in the following called AKD) or alkenyl succinic acid anhydride (in the following called ASA).

Alkyl ketene dimer, which are used in the first place when the demands on a durable and permanent hydrophobation are great, can react with the cellulose when the paper or the paper board is being dried wherein beta-ketoesters are established. In the figure below, the reaction between AKD and cellulose and the hydrolyse reaction are illustrated:

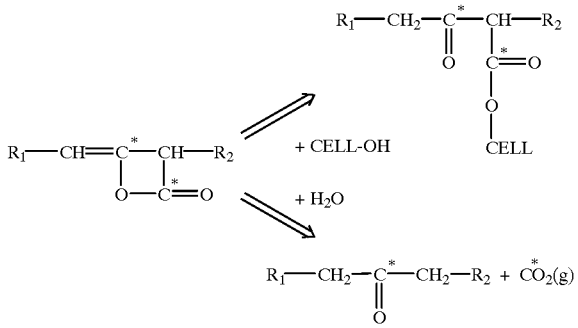

The reaction is slow at low pH values and in practice AKD can not be used other than in the neutral or weakly alkali pH range. Instead of reacting with the fibre during the paper or paper board manufacturing, AKD also can be hydrolysed such that an unstable beta-keto acid is obtained, which can be decarbonated to corresponding ketone. The hydrolysed products which are formed during the paper manufacturing process, i.e. the ketone products that are obtained, are very disturbing for certain types of photo copying apparatuses, in which these ketones may form depositions.

The degree of the hydrolysis reaction for AKD, however, is substantially smaller in comparison with ASA.

This implies that AKD usually is supplied to the paper or board mill in the form of a dispersion or emulsion which has a particle size of between 0.2 to 2 micrometers. The dispersion or emulsion usually is stabilised by means of a cation-active polymer. This polymer, which also gives the particles their charge, usually consists of cation-active starch but also use of anion-active or amphoteric starches or synthetic polymers occur.

AKD has a melting point of between 15–60° C., depending on the length of the fatty tail. The commercial products which are most commonly used so far often have a mixture of $C_{14}$, $C_{16}$, and $C_{18}$ hydrocarbons, implying a melting point of between 40–60° C.

AKD is particularly sensitive in the presence of extractive agents of the fatty acid type, because such agents are saponificated at alkalic pH values and also because they compete with the distribution on the cellulose surface. A poor AKD distribution will result in a poor chemical reaction with the fibre. Groundwood, thermo-mechanical pulps and chemi-mechanical pulps therefor are difficult to hydrophobate by means of AKD.

The most pronounced drawback with AKD, however, is that the hydophobicity is developed slowly. A completely developed sizing is not achieved until after several days after the manufacturing in the paper or the board machine.

Another drawback is that a too large dosage of AKD causes friction problems in connection with the paper or the board/paper board. AKD also impairs the toner addition in connection with the photocopying processes as well as the adherence of the plastic layer in connection with the manufacturing of plastic laminated materials.

Alkenyl succinic acid anhydride (ASA) is another example of a so called cellulose-reactive hydrophobation agent. The anhydride can react with the hydroxyl groups of the cellulose, wherein a transesterification takes place. In comparison with AKD, ASA has a much higher reactivity with the cellulose and hence also with water, wherein hydrolysis of the product is a greater problem for ASA than for AKD.

ASA is delivered to the paper mill in the form of oil, sometimes with emulgator added. Emulsification takes place in a special emulsification equipment in connection with the paper or board manufacturing machine (so called in situ production) and cationic, anionic or amphoteric starch or other polymer is used as a stabiliser and charge carrier. The particle size of the emulsion usually is 1–5 micrometers. Larger particles are hydrolysed more slowly but smaller particles provides a better distribution on the cellulose fibres, wherefore there exists an optimal particle size. ASA thus is hydrolysed quickly and the hydrolysis product and its salts with $Ca^{2+}$ are sticky and frequently give rise to depositions in the paper or paper board manufacturing process. The hydrolysis as well as the reaction velocity are increased with increased pH, but the reaction is fast over the entire pH range. The hydrophobicity is developed fast and is usually fully developed is the finishing part of the paper and paper board manufacturing process.

Below, the reaction between ASA and cellulose is illustrated:

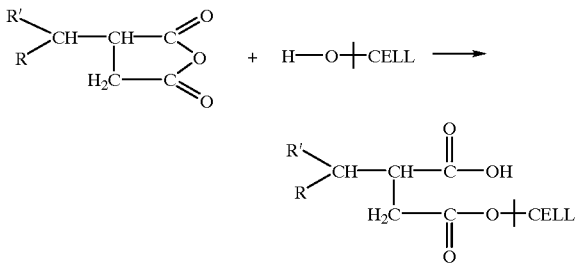

where R or R' is an alkenyl.

In connection with the more and more common use of precipitated calcium carbonate, so called PCC, as a filler during the paper and paper board manufacturing, the need of a hydrophobic sizing agent is increased considerably for the achievement of the same degree of sizing as is achieved in a corresponding process where e.g. chalk is used as a filler. Moreover, often problem occur which have to do with the fact that the hydrophobation effect is reduced after a period of time.

To sum up, one can thus state that both the two hydrophobation agents have specific advantages and drawbacks when used in the paper or paper board manufacturing process as well as in the finished paper or paper board product.

DISCLOSURE OF THE INVENTION

The purpose of the invention is to provide a size composition where the above mentioned problems have been eliminated or restricted. This can be achieved therein that the hydrophobic, cellulose-reactive particles of the emulsion or dispersion exist as a physical mixture of at least two hydrophobic, cellulose-reactive sizing agents. More particularly, the invention according to the elected embodiment is characterised in that said at least two hydrophobic, cellulose-reactive sizing agents comprise at least alkyl ketene dimer (AKD) and alkenyl succinic acid anhydride (ASA). By means of this composition there are achieved effects which substantially reduce or eliminate many of the shortcomings which can be related to the known technique. Among these known problems can be mentioned, i.e., slow development of the hydrophobation effect, poor adherence of toner and deposition hydrolysis products in connection with photocopying and reduced efficiency during the paper and paper board manufacturing process because of stops in connection with the formation of hydrolysis products. The size composition is manufactured according to a so called in situ method, i.e. in close connection to the use of the composition, i. e. in practise in connection to the machine or those machines which are used for the manufacturing of the paper. the board, or the paper board. This also can be expressed such. that the size composition, according to the invention, in the form of the aqueous emulsion or dispersion is prepared not more than 4 hours, preferably not more than 1 hour, suitably not more than 30 minutes, before the use of the composition in the paper, paper board, or board manufacturing process. All known shortcomings in connection with the tecnique known so far, can surprisingly substantially be reduced or eliminated through the invention without impairing the favourable features which characterise the two hydrophobic, cellulose-reactive sizing agents taken alone.

Surprisingly, one has also found that the new size composition substantially reduces the sizing problems, such as low hydrophobation effect and reduction of the hydrophobation effect by time, which occur when precipitated calcium carbonate, so called PCC, is used as filler in the paper and paper board manufacturing process.

A main purpose of the invention therefor is to provide a new and improved composition which can be used for sizing paper, board, paper board and similar products.

Another purpose of the invention is to provide a new size composition which is more efficient than previously known compositions, therein that reduced quantities of the sizing agent are required for the achievement of a hydrophobation degree similar to or corresponding to that of the previously known compositions.

Still another object of the invention is to provide a new size composition, the sizing influence or sizing ability of which is developed faster than with the previously known compositions.

Another purpose of the invention is to provide a new size composition with which the unfavourable effects on the hydrophobation effect are considerably reduced or eliminated in connection with use of precipitated calcium carbonate.

Still another purpose is to provide a new size composition, wherein the amount of the undesired hydrolysis products which are obtained in the paper or paper board manufacturing process when the known size compositions are used, are considerably reduced or eliminated.

Further there is an object of the invention to bring about an improved method for the manufacturing of a size composition as described above.

Further there is an object to bring about an improved method for the manufacturing of a sized paper or board or paper board, including the use of the new composition of the invention.

Another object of the invention is to provide sized paper or sized board or sized paper board having improved features by the use of the new composition and the improved process at the manufacturing thereof.

According to the invention these and other objectives are achieved through the provision of a size composition in the form of an aqueous (water based) dispersion or emulsion, in which the hydrophobic, cellulose-reactive partides of the emulsion or dispersion exist as a physical mixture of at least two hydrophobic, cellulose-reactive sizing agents, wherein the emulsion also contains starch or other natural polymer and/or at least any synthetic polymer, e.g. polyacrylamide.

Preferably, said at least two hydrophobic, cellulose-reactive sizing agents consist of particles of alkyl ketene dimer and alkenyl succenic acid anhydride, wherein the dispersed or emulsified size composition is prepared in connection with the paper and paper board manufacturing process, i. e. shortly before the composition shall be used, preferably not more than 4 hours, suitably not more than 1 hour and most preferably not more than 30 minutes before the use.

As far as the new size composition of the invention is concerned, it should be understood that it also may contain further ingredients if desired or if considered suitable, wherein such further ingredients may be chosen according to known principles. Although such ingredients need not be particularly described here in order to make it possible to carry out the invention, it may, however, be mentioned that among normal additions can be mentioned e. g. dispersing agents, aluminium compounds such as alum (aluminium sulphate) and poly-aluminium chloride. The starch or synthetic polymer existing in the dispersion or emulsion may have a cation-active or anion-active or amphoteric character.

EXAMPLE

The above described size composition can be prepared in the following way. 25 parts of a wax consisting of alkyl ketene dimer (AKD) is melted. The wax usually has a melting point between 30–60° C. depending on the length of the fatty chains in the raw material. Wax with a melting point down to 15° C. also can be used. To this melt there is added 25 parts of an oil consisting of alkenyl succinic acid anhydride (ASA).The mixture is stirred such that a homogenous. physical mixture is achieved. This mixture of AKD and ASA, during stirring, is added to a solution of 100 parts of cation-active starch and 2 parts of an anion-active dispersion agent and 2500 parts of water in a dispersion/emulsifying device in which it is subjected to so high shear forces that a dispersion or, alternatively, an emulsion is formed. The temperature of the starch solution should be a few ° C. higher than the melting point of the AKD/ASA mixture. The dispersion or emulsion thereafter is cooled rapidly. A temperature less than 20° C. is preferable.

As previously mentioned, the AKD/ASA ratio can vary very much depending on the features which are desired in the first place. At a low AKD/ASA ratio, the mixture of AKD and ASA is liquid at room temperature which facilitates the preparation of the emulsion. If desired, the AKD/ASA mixture can be prepared by the supplier of these raw materials. The mixture in that case may be delivered e.g. in a container, wherein the mixture is heated to liquid state e.g. by means of an immersion-heater at a higher AKD/ASA ratio. The mixture also can be delivered as a bulk cargo, wherein its temperature is just above the melt temperature of the mixture during transport and storing. In both these cases the AKD/ASA mixture can be delivered to the user in a concentrated form in order to be prepared at the user's place by being mixed also with starch or other natural polymer and/or with synthetic polymer and being emulsified or dispersed in an aqueous medium shortly before use.

In the above described example, it may, as has been previously mentioned, in certain cases be more suitable to use anion-active starch or amphoteric starch or synthetic polymer instead of cation-active starch. Also other additions, such as for example polyaluminium chloride or alum (aluminium sulphate) may be advantageous.

The sizing dispersion or sizing emulsion thus obtained is a milky liquid having a low viscosity, which after dilution is dosed to the stock during the course of the paper, board or paper board manufacturing process. Suitably, the size composition may be dosed at any dosage point between the mixing through and the head box. The amount of dosage may vary depending on different process parameters, such as type of used pulps and fillers, temperature in the system and existence of disturbing substances. Usually the amount of dosage may vary from 0.4 to 1.4 kg total solid content/ton paper board or paper board.

What is claimed is:

1. Size composition in the form of an aqueous emulsion or dispersion comprising at least one particulate hydrophobic, cellulose-reactive sizing agent and at least one natural and/or synthetic polymer, wherein the hydrophobic, cellulose-reactive particles of the emulsion or dispersion exist as a physical mixture of at least two hydrophobic cellulose-reactive sizing agents, one of which consists of alkenyl succinic acid anhydride, and wherein the ratio between one hydrophobic cellulose-reactive sizing agent and alkenyl succinic acid anhydride is at least 1/100 and not more than 100/1.

2. Size composition according to claim 1, wherein said at least two hydrophobic, cellulose-reactive sizing agents comprise at least alkyl keten dimer and alkenyl succinic acid anhydride.

3. Size composition according to claim 2, wherein the ratio between alkyl keten dimer and alkenyl succinic acid anhydride is at least 5/100 and not more than 100/5.

4. Size composition according to claim 1, wherein it is prepared in a dispersion or emulsifying equipment according to an in situ process.

5. Method for the manufacturing of sized paper, sized board or sized paper board, comprising adding a sizing agent according to claim 1 during manufacturing of said paper or board or paper board prior to dewatering thereof.

6. Method according to claim 5, wherein the size composition is added in an amount of at least 0.25 kg and at most 4 kg of total solid content per ton paper, board or paper board.

7. Method according to claim 6, wherein the size composition is added in an amount of at least 0.4 kg and at most 1.4 kg of total solid content per ton paper, board or paper board.

8. Method according to any of claim 5, wherein the size composition is prepared not more than 4 hours before it is added during the manufacturing of said paper, board or paper board before dewatering thereof.

9. Method according to claim 8, wherein the size composition is prepared not more than 1 hour, before it is added during the manufacturing of said paper, board or paper board before dewatering thereof.

10. Method according to claim 9, wherein the size composition is prepared not more than 30 minutes before it is added during the manufacturing of said paper, board or paper board before dewatering thereof.

11. Method according to claim 5, wherein the size composition is prepared before it is added during the manufacturing of stock before dewatering thereof.

* * * * *